US007084336B2

(12) United States Patent
Towers

(10) Patent No.: US 7,084,336 B2
(45) Date of Patent: Aug. 1, 2006

(54) USER-ADJUSTABLE ERGONOMIC STRINGED MUSICAL INSTRUMENT

(76) Inventor: James Michael Towers, 403 Washington Ave., Ephrata, PA (US) 17522

( * ) Notice: Subject to any disclaimer, the term of this patent is extended or adjusted under 35 U.S.C. 154(b) by 0 days.

(21) Appl. No.: 10/839,579

(22) Filed: May 5, 2004

(65) Prior Publication Data

US 2005/0247183 A1 Nov. 10, 2005

(51) Int. Cl.
*G10D 1/08* (2006.01)

(52) U.S. Cl. ..... 84/267

(58) Field of Classification Search ..... 84/267, 84/290–293, 298; D17/99
See application file for complete search history.

(56) References Cited

U.S. PATENT DOCUMENTS 4,534,260 A * 8/1985 Burrell ..... 84/293
5,251,526 A * 10/1993 Hill ..... 84/263
5,852,249 A 12/1998 Steinberg
6,034,308 A 3/2000 Little
2003/0217634 A1* 11/2003 Zigounakis ..... 84/293

* cited by examiner

*Primary Examiner*—Kimberly Lockett
(74) *Attorney, Agent, or Firm*—Andrew D. Mead

(57) ABSTRACT

The apparatus is a user-adjustable stringed musical instrument. A rotary joint mechanism connects an acoustic body to a movable string support assembly. The movable string support assembly is comprised of common elements of a stringed musical instrument. The rotary joint mechanism enables the orientation of the instrument strumming and fingering surfaces to be rotated relative to the transverse plane of the acoustic body. Orientation of the playing surfaces may be varied during play to achieve a more comfortable position for either the fingering hand or the strumming hand thereby improving ergonomics of the instrument.

2 Claims, 3 Drawing Sheets

USER-ADJUSTABLE ERGONOMIC STRINGED MUSICAL INSTRUMENT

BACKGROUND OF THE INVENTION

1. Field of the Invention

This invention relates generally to stringed musical instruments and more specifically to guitar or bass instruments ergonomically designed to reduce the risk of repetitive strain injuries to the player's hands, wrists and arms, to which guitar and bass players are prone, by making the instrument more comfortable to play.

Playing a stringed musical instrument requires a high degree of dexterity. Hand and finger movements must be finely controlled, and the movements are often performed rapidly and repetitively. These movements are frequently performed over extended periods of time, which can result in repetitive strain injury. Guitar and bass players are particularly at risk due to the hand and wrist positions required to play the instrument. The musician's arm must be extended to access the fingerboard, and the wrist is frequently hyperflexed to allow the fingers to reach the strings. Wrist strain is exacerbated when the musician plays bar chords. Rapid, repetitive, finger motion performed while the wrist flexor muscles are tensed increases the likelihood of repetitive strain injury.

The present invention addresses a solution to the problem repetitive strain injuries suffered by guitar and bass players.

2. Description of Related Art

Several proposed solutions to this problem have been developed wherein the instrument fingerboard is rotated in such a manner to reduce the degree of wrist flexion experienced during play. U.S. Pat. No. 4,534,260 by Burrell describes a stringed instrument whose neck is progressively twisted along the fingerboard length to make chording finger positions more comfortable. U.S. Pat. No. 5,852,249 by Steinberg discloses an improvement to Burrell intended to reduce inadvertent string contact with higher frets while strings are being fingered on the lower frets. U.S. Pat. No. 6,034,308 by Little describes another improvement to Burrell which extends the fingerboard twist into the strumming area to optimize playing position for the musician's strumming and fingering hands.

These instruments retain many conventional features of stringed musical instruments, including body structures that enhance the instrument's tonality. The problem with these instruments is that they are not adjustable by the musician once the instrument is built. Musicians must adapt their playing style to the instrument regardless of whether the particular arm, wrist and hand orientation is optimum for them. While playing position and comfort are generally improved, it may not be the most comfortable position for an individual musician.

U.S. Pat. No. 5,251,526 by Hill discloses a two-sided, stringed instrument with a rotating neck and bridge assembly having strings on both sides. The assembly is connected to a body by an axle. The axle allows movable assembly rotation about the neck axis so that either side of the assembly can be played. The body serves as a connection point so that the rotating neck can be supported away from the musician's body during play. The open design of the body is such that both sides of the assembly can be played simultaneously. This instrument offers the flexibility of having two instruments of differing voices, such as a guitar and a bass, combined in a single instrument making both voices readily available for play without requiring time to swap between two separate instruments.

The problem with this instrument is that it addresses the problem of simultaneous play of multiple stringed voices (e.g., guitar and bass) but does not attempt to address musician comfort or ergonomics. The body serves to separate the rotating neck from the musician's body. Its open design and rotary mechanism allow simultaneous play of both voices, but compromise instrument tonality in the process.

SUMMARY OF THE INVENTION

The present invention provides a stringed musical instrument that is adjustable by the musician while playing to obtain a more comfortable, and hence more ergonomic, playing position. The adjustment mechanism itself may also be adjusted to vary resistance to movement to suit the musician's preference. In addition to user-adjustability, an acoustic body and a robust connection between the acoustic body and the movable portion of the instrument enhance instrument tonality and provide a richer sound generally associated with larger, solid-bodied guitars. The primary objective of the present invention is to provide a user-adjustable instrument that enhances musician comfort without sacrificing tonal quality of the instrument.

The present invention provides a moveable string support assembly that allows the plane of the fingerboard to be oriented so that wrist flexion for the fingering hand is maintained in a relatively neutral position. Downward orientation of the fingerboard plane, as viewed by the musician, reduces the angle between the musician's forearm and the fingerboard plane and requires less wrist flexion to reach the fingerboard, especially when fingering a bar chord.

The moveable string support assembly also allows the strumming surface to be oriented to allow a musician to find the most comfortable playing position for the strumming hand. Rotating the movable string support assembly so that the plane of the strings relative to the plane of the fixed body is oriented upward, as viewed by the musician, reduces wrist flexion in the strumming hand and enhances comfort. Upward orientation of the movable string support assembly also affords the musician a better view of the fingerboard, benefitting beginning musicians as they learn fingering positions.

As the moveable string support assembly is user adjustable while being played, the musician may vary the position of the fingerboard or strumming surface during play to obtain the most comfortable playing position for either the fingering hand or the strumming hand. Movable string support assembly rotation is accomplished by fingering hand input to the instrument's neck. Upward, downward, or neutral orientation may be selected during play to alter playing position to suit the particular musical demands or improve musician comfort. The instrument's resistance to rotation may also be adjusted so that the musician can control the feel of the rotating mechanism to suit individual playing preferences.

DETAILED DESCRIPTION OF THE INVENTION

Figure 1:
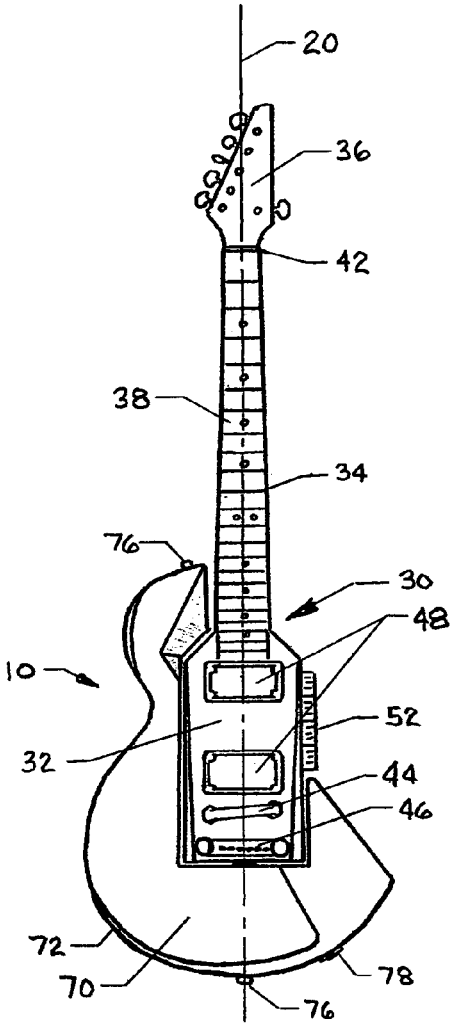
FIG. 1 is a front view of the invention showing a movable string support assembly, an acoustic body, and a rotational axis.

The preferred embodiment of the invention shown in FIG. 1 consists of a user-adjustable, ergonomic, stringed musical instrument 10 constructed of any suitable material having a movable string support assembly 30 and an acoustic body 70. Movable string support assembly 30 and acoustic body 70 are connected by means of rotary joint mechanism 100, shown in FIG. 2, that allows rotation of movable string support assembly 30 about rotational axis 20. Movable string support assembly rotational position is described by rotation angle $\phi$, shown in FIGS. 1A and 1B. The embodiment of stringed musical instrument 10 shown is a right-handed electric guitar, but may be any stringed musical instrument. The embodiment shown could also be produced in mirror image for left-handed play.

Referring to FIG. 1, movable string support assembly 30 includes movable body 32 and a conventional headstock 36 connected by a conventional neck 34. Bridge 44 and tailpiece 46, also conventional items, are attached to movable body 32 proximate to acoustic body 70. Neck 34 is attached to movable body 32 and extends away from movable body 32. Neck 34 incorporates conventional fingerboard 38. Headstock 36 incorporates conventional tuning pegs 40. A plurality of strings, not shown, are attached to tailpiece 46 at one end and to tuning pegs 40 at the opposite end. The strings span between bridge 44 and conventional nut 42, located at the interface between neck 34 and headstock 36, in an approximately parallel arrangement and located slightly displaced from the surface fingerboard 38. Conventional pickups 48 used to convert string vibrations into electrical signals, are affixed to movable body 32 approximately parallel to the plane of the strings and slightly displaced from the plane of the strings. The portion of strings spanning between pickups 48 is generally referred to as the strumming area, though instrument play is not limited to strumming or plucking the strings in this area. FIG. 1 also shows sound conventional control assembly 52 located on movable body 32. Locating sound control assembly 52 proximate to the strumming area allows easy adjustment with the strumming hand without moving the hand far from the normal playing position. A portion of acoustic body 70 is removed to allow access to sound control assembly 52. When acoustic body 70 and movable string support assembly 30 are connected, the resulting instrument approximates the general appearance of a guitar in the embodiment described.

Figure 1A:
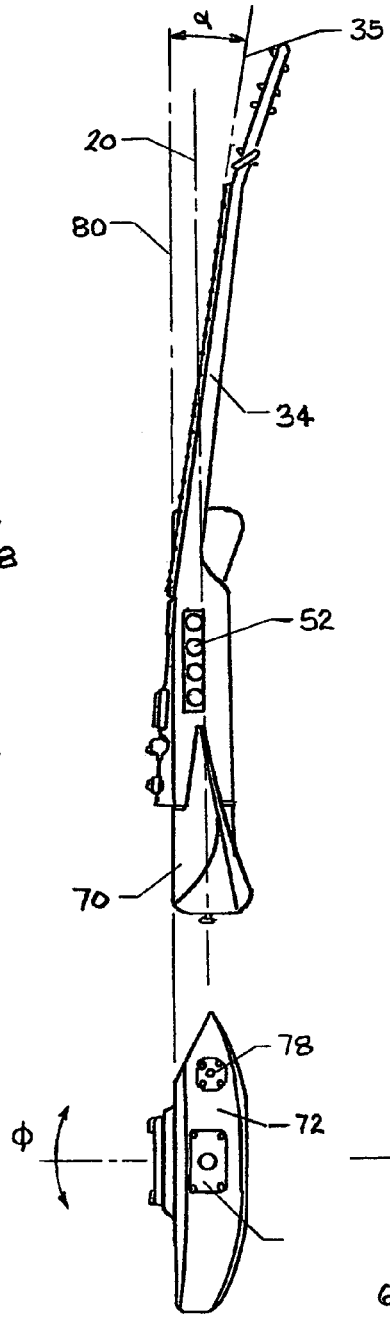
FIG. 1A is a side and end view of the invention with the movable string support assembly shown in a neutral position.
Figure 1B:
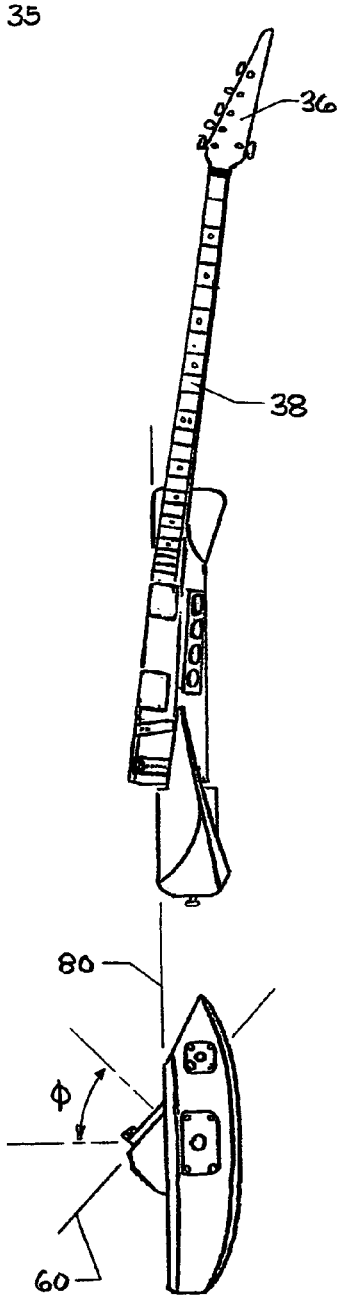
FIG. 1B is a side and end view of the invention with the movable string support assembly shown rotated approximately 45 degrees downward. This figure also illustrates changes in the acoustic body that allow access to the strumming surface and sound controls.

FIG. 1A shows the side and end views of the invention with movable string support assembly 30 shown in a neutral position. The movable string support assembly 30 can rotate about rotational axis 20 in either a clockwise or counter-clockwise direction. Rotational angle $\phi$ is defined as 0 when a plane normal to reference plane 60 and a plane normal to acoustic body transverse plane 80 are parallel, as shown in FIG. 1A. FIG. 1A also shows neck 34 displaced relative to a flat transverse plane of the instrument, and oriented along longitudinal neck axis 35. Angle $\alpha$ is formed between longitudinal neck axis 35 and acoustic body transverse plane 80. Angle $\alpha$ is not user-adjustable, is conventional in the art, and ranges between 3 and 8 degrees. Angle $\alpha$ positions neck 34 so that the distance the musician must reach to finger the distal end of neck 34 is reduced. FIG. 1A also shows the location of conventional output jack 78 on outer perimeter 72. Output jack 78 allows the electrical output of the instrument, generated by pickups 48, to be directed to a sound amplifier Referring to FIG. 1B, the invention is shown with a rotational angle $\phi$ approximately 45 degrees. In this position, the orientation of fingerboard 38 is rotated downward from the musician's perspective, reducing fingering hand wrist flexion. FIG. 1B also illustrates how the exterior surfaces of acoustic body 70 are modified from a conventional guitar body to provide access to the strumming area and to sound control assembly 52.

Figure 2:
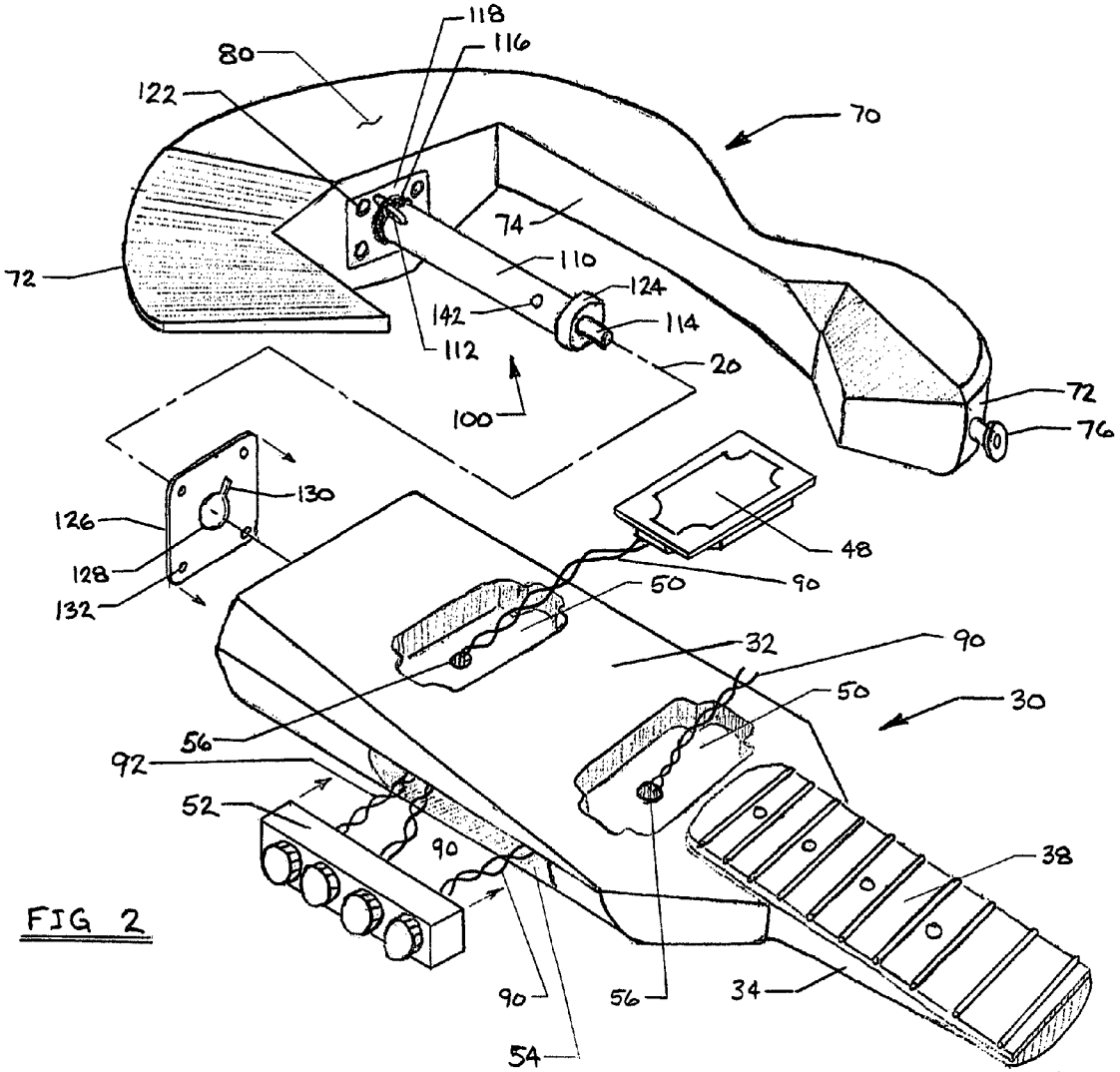
FIG. 2 is a perspective view of the acoustic body showing the rotary joint mechanism and a portion of the movable string support assembly. The invention is shown in a disassembled state as would be required for the user to adjust resistence to rotational movement.

FIG. 2 shows acoustic body 70, rotary joint mechanism 100, and a portion of movable string support assembly 30. Acoustic body 70 is multi-planar and includes an outer perimeter 72, an inner cutout perimeter 74, and a plurality of strap connectors 76 located on outer perimeter 72 to attach a strap so that the instrument can be supported by the musician when playing while standing. Inner cutout perimeter 74 is shaped to generally mimic the perimeter of movable body 32 with a space existing between acoustic body 70 and movable body 32 to allow relative movement between them. In the preferred embodiment, acoustic body 70 is made from maple wood, chosen for its tonal characteristics exhibited in conventional solid body guitars.

Movable body 32, as shown in FIG. 2, includes a plurality of pickup receiving structures 50 to contain electrical pickups 48, and a sound control receiving structure 54 to provide a mounting location for sound control assembly 52. Sound control assembly 52 contains conventional sound and volume controls for each pickup 48. A plurality of pickup conduits 56 within movable body 32 allows pickup conductors 90 to connect the output signal from pickups 48 to sound control assembly 52. Movable string support assembly 30 is, in essence, a stringed musical instrument except that movable body 32 is smaller than is common in the art.

Rotary joint mechanism 100 in the present invention allows rotational movement of movable string support assembly 30 relative to acoustic body 70. The rotary joint mechanism is sufficiently strong to withstand bending moments created by having the entire mass of movable string support assembly 30 supported by the mechanism as well as additional bending moments created when the musician applies force to neck 34. In addition to structural capability, the connection between rotary joint mechanism 100 and acoustic body 70, and between rotary joint mechanism 100 and movable string support assembly 30 is sufficient to transmit instrument vibrations thereby allowing the resonate characteristics of acoustic body 70 to influence instrument tonality and provide a rich sound generally characteristic of electric guitars with large, solid bodies.

Figure 3:
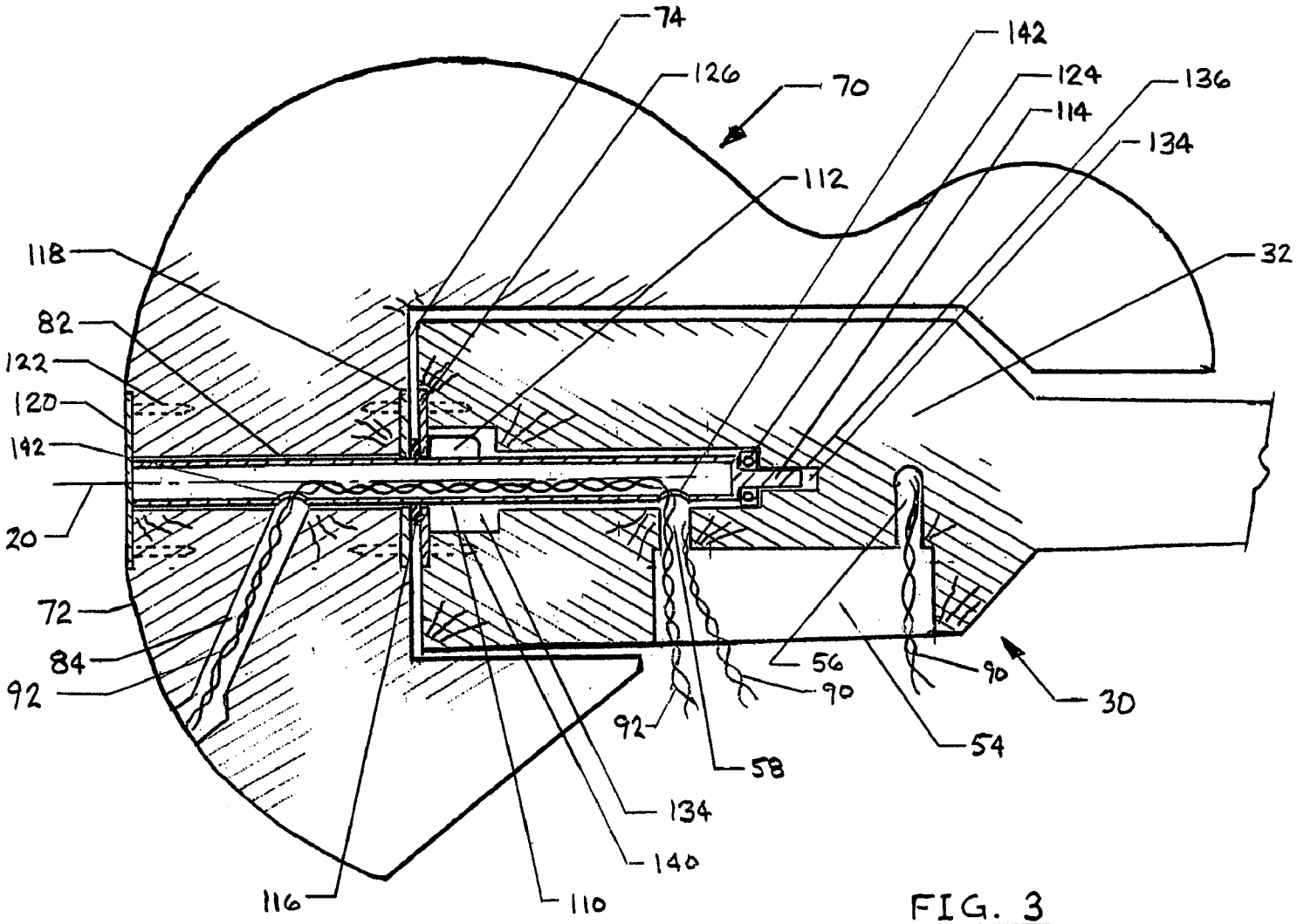
FIG. 3 shows a cross section view of the invention along a plane through the rotational axis and parallel to the acoustic body transverse plane. This view illustrates elements of the rotary joint mechanism and conduits for directing wires from the pickups through the controls and to an output connection.

FIG. 3 shows the invention in cross section view along a plane through the rotational axis and parallel to the acoustic body transverse plane. This view illustrates elements of the rotary joint mechanism 100. Pickup conduits 56 for directing pickup conductors 90 to sound control assembly 52 are shown. Also shown are output conduit 58, output conduit openings 142, the hollow interior of inner elongated structure 110, and output jack conduit 84 for directing output signal conductors 92 to output jack 78.

Rotary joint mechanism 100 includes inner elongated structure 110 affixed to end mounting bracket 120 and extending through acoustic body interior structure 82. Inner elongated structure 110 is connected to acoustic body 70 by end mounting bracket 120 located on outer perimeter 72 and by intermediate mounting bracket 118 located on inner cutout perimeter 74, where acoustic body interior structure 82 penetrates inner cutout perimeter 74. The dimensions of acoustic body interior structure 82 approximate the dimensions of inner elongated structure 110 so that inner elongated structure 110 fits tightly within acoustic body 70. Intermediate mounting bracket 118 is not affixed to inner elongated structure 110, but contains an opening sized to allow inner elongated structure 110 to pass through to aid in instrument construction while restraining undesirable movement. End mounting bracket 120 and intermediate mounting bracket 118 are attached to acoustic body 70 by a plurality of fasteners 122. When assembled, inner elongated structure 110 is rigidly affixed to acoustic body 70 in a manner that precludes relative movement between them.

In the preferred embodiment, inner elongated structure 110 is cylindrical in nature, and made of steel tube having an outside diameter of 1 inch and a wall thickness of ⅛ inch. Other materials and sizes may be used provided the material is sufficiently strong and sizes will fit within the outer elongated structure 134, as described below. The hollow interior of inner elongated structure 110 provides a conduit for wires from sound control assembly 52 to output jack 78. A plurality of output conduit openings 142 is provided in inner elongated structure 110 to allow output signal conductors 92 to be directed from output conduit 58 the hollow interior of inner elongated assembly 110 and then to output jack conduit 84. For non-electric stringed instruments or instruments using radio-frequency transmitters for signal output, a lighter, hollow, inner elongated assembly reduces overall mass of the instrument compared to an elongated assembly made from a solid material.

Inner elongated structure 110 extends approximately 8 inches from inner cutout perimeter 74. Inner elongated structure 110 includes alignment pin 114 located at the distal end of inner elongated structure 110 from end mounting bracket 120. Alignment pin 114 is cylindrical in nature, affixed to inner elongated structure 110, approximately ¼ inch in diameter, and extends approximately 1-½ inches from the end of the inner elongated structure. Assembly tab 112 is affixed to the outer circumference of inner elongated structure 110 in the region where it protrudes from inner cutout perimeter 74.

Outer elongated structure 134 is shaped to accommodate inner elongated structure 110. The interface between the two structures when the instrument is in its assembled configuration limits movement between acoustic body 70 and movable string support structure 30 to rotation about rotational axis 20 except when movable string support assembly is positioned for disassembly; axial movement along rotational axis is possible when movable string support assembly is positioned for disassembly. Outer elongated structure 134 is a multi-dimensional cavity within movable body 32 extending from the end of movable body 32 proximate to backplate 126, into movable body 32 along rotational axis 20. Outer elongated structure 134 is generally cylindrical in nature having three distinct portions of different diameters, all centered about rotational axis 20. Outer elongated structure 134 consists of alignment structure 136, bearing housing 138, assembly tab housing 140, and backplate 126.

Alignment structure 136 is located at the end of outer elongated structure 134 distal from backplate 126. Bearing housing 138 is located adjacent to alignment structure 136. The diameter of bearing housing 138 coincides with the outer diameter of bearing 124 and is slightly larger in diameter than the diameter of inner elongated structure 110. Bearing housing 138 extends axially at least the distance needed to contain bearing 124, but in the preferred embodiment shown, extends to the point where it abuts assembly tab housing 140. Assembly tab housing 140 is located at the end of outer elongated structure 134 closest to backplate 126. Assembly tab housing 140 is bounded by backplate 126 and bearing housing 138. The minimum length of assembly tab housing 140 is slightly longer than the total length of assembly tab 112, approximately 1 inch in the preferred embodiment. The maximum length of the assembly tab housing 140 is constrained by the axial length of bearing housing 138.

Alignment structure 136 receives alignment pin 114. Radial clearance between alignment structure 136 and alignment pin 114 is sufficiently small to limit movement to rotational movement and large enough so that friction does not prevent rotation. Bearing 124 is located on alignment pin 114 at the end proximate to its connection to inner elongated structure 110. Bearing 124 increases the capability of alignment pin 114 to handle the forces to which it may be subjected without dramatically altering the friction resistence inherent in the alignment pin/alignment hole interface.

Movable body 32 incorporates a plurality of interior structures to allow conventional electrical signal conductors to be routed within the movable body, shown in FIGS. 2 and 3. These interior structures consist of pickup receiving structures 50, pickup conduits 56, sound control receiving structure 54, and output conduit 58. The hollow interior of inner elongated structure 110 also functions as a signal conductor conduit. A plurality of pickups 48 are each located in a pickup receiving structure 50. Pickup conduits 56 allow pickup conductors 90 to be directed from pickups 48 to sound control assembly 52, which is located in sound control receiving structure 54. Pickup conduits 56 have generally circular cross sections in the preferred embodiment, but other cross sections may be employed. The instrument output signal is directed through output signal conductors 92 are directed from sound control assembly 52 through output conduit 58. Output conduit 58 connects to and penetrates the surface of outer elongated structure 134, allowing output signal conductors 92 to be directed through an output conduit opening 142 in inner elongated assembly. The hollow interior of inner elongated structure 110 provides a conduit for output wires to be directed from movable string support assembly 30 toward acoustic body 70. Another output conduit opening 142, located in the portion of inner elongated structure 110 interfacing with acoustic body interior structure 82, allows the output signal conductors 92 to enter output jack conduit 84 and be connected to output jack 78.

Sound control assembly 52 is affixed in sound control receiving structure using conventional spring clips, not shown, so that sound control assembly 52 may be easily removed from sound control receiving structure 54, thereby providing user access to signal conductor connections on sound control assembly 52. The connections are positioned in sound control assembly receiving structure 54 when sound control assembly 52 is in its assembled location. Removing sound control assembly 52 from sound control receiving assembly 54 allows the output signal conductors 92 to be disconnected from sound control assembly 52 so that the movable string support assembly 30 can be separated from acoustic body 70.

Output conduit 58 and the pickup conduit 56 associated with the pickup closest to bridge 44 are combined to form a single passageway within movable body 32 having a cross sectional shape in the nature of two semi-circles connected by tangential lines, better described as a rounded slot. The shape of the combined passageway where it intersects outer elongated structure 134 provides an elongated opening in the circumference of outer elongated structure that prevents the output signal conductors 92 from being sheared as movable string support assembly 30 is rotated.

Backplate 126 is affixed to the end of movable string support assembly 30, and serves as the end boundary of outer elongated structure 134. Backplate 126 provides a bearing interface between outer elongated structure 134 and inner elongated structure 110. Referring to FIG. 2, backplate 126 includes opening 128, assembly slot 130, and a plurality of mounting holes 132 used to attached backplate 126 to movable string support assembly 30. Assembly tab 112 is affixed on the outer circumference of inner elongated structure 110 and is located in contact with the side of backplate 126 adjacent to outer elongated structure 134 when the instrument is assembled. Spacer washer 116 is positioned between intermediate mounting bracket 118 and backplate 126 when the instrument is assembled. Spacer washer 116 is made from an elastomer having a hardness ranging from 60 to 85 measured using the Shore A durometer scale. Compression of the spacer washer limits movement of the movable string support axially along rotational axis 20 and provides resistance to rotational movement. By varying either the hardness of spacer washer 116 or the nominal thickness of spacer washer 116, which varies the initial compression in the washer when the instrument is assembled, the resistance to rotation of the movable string support assembly can be altered to suit the musician's preference thereby enhancing the overall feel of the instrument to the musician.

Rotary joint mechanism 100 allows movable string support assembly 30 to rotate about rotational axis 20 in either a clockwise or counterclockwise direction. Rotation angle $\phi$ is not limited by rotary joint mechanism 100; the rotary joint mechanism does not include positive travel stops. However, rotation is practically limited by the length of output signal conductors 92 and the size of the combined opening of output conduit 58 and pickup conduit 56 where they intersect outer elongated structure 134. Musician comfort is best realized when rotational angle $\phi$ is within a range of 0 and 45 degrees in either direction with 0 degrees occurring when a plane normal to reference plane 60 and a plane normal to acoustic body transverse plane 80 are parallel. The length of output signal conductors 92 and the size of the combined opening of output conduit 58 and pickup conduit 56 where they intersect outer elongated structure 134 allows rotational motion within the normal playing range. The exact location of assembly tab 112, both axially and circumferentially, is determined by the relationship between movable string support assembly 30 and acoustic body 70, and by the location of assembly slot 130 on backplate 126, shown on FIG. 2. The position of assembly tab 112 and assembly slot 130 are established so that they do not align within a range of rotational angle $\phi$ of 0 to 45 degrees in either direction, thereby preventing inadvertent separation of movable string support assembly 30 from acoustic body 70 while the instrument is being played.

Ergonomic playing position is enhanced by allowing the musician to choose the position of movable string support assembly 30 to provide a more comfortable playing position for either the fingering hand or the strumming hand. Rotating movable string support assembly 30 downward from the musician's perspective, illustrated in FIG. 1B, positions fingerboard 38 in a manner that reduces wrist flexion on the fingering hand. This position improves comfort when rapid fingering positions or bar chords are required. Rotating movable string support assembly 30 upward from the musician's perspective reduces wrist flexion on the strumming hand and enhances musician comfort when picking the strings. The upward position also improves the musician's view of fingerboard 38, benefitting both beginning musicians as they learn fingering positions and experienced musicians wanting a better view of their fretting fingers as they pick the strings with their strumming hand. The instrument's capability to be easily positioned during play enables the musician to achieve a more comfortable playing position and to alter playing position to suit the particular musical demands.

It is to be understood that the form of this invention as shown is merely a preferred embodiment. This invention may be embodied in several forms without departing from its function. Various changes may be made in the function and arrangement of parts; equivalent means may be substituted for those illustrated and described; and certain features may be used independently from others without departing from the spirit and scope of the invention as defined in the following claims.

I claim:

1. A user-adjustable stringed musical instrument comprising:

an acoustic body having an exterior surface, an inner cutout structure, and resonate characteristics;

a movable string support assembly located within the inner cutout structure comprising a rotatable movable body, a bridge, a nut, a neck, a plurality or strings, and a rotational axis for the entire string support assembly; and a rotary joint mechanism connecting said acoustic body to said movable string support assembly that provides a resonate connection between said acoustic body and said movable string support assembly, enabling said movable string support assembly to rotate on the rotational axis in relation to said acoustic body wherein the angular position of said movable string support assembly can be adjusted, the rotary joint mechanism further comprising:

an inner elongated structure;

an outer elongated structure;

at least one spacer washer;

an assembly tab affixed to said inner elongated structure; and an assembly slot in said outer elongated structure enabling said acoustic body and said movable string support assembly to be separated so that said spacer washer can be adjusted or replaced.

2. The rotary joint mechanism of claim 1, in which said spacer washer imparts resistance to rotation of said rotary joint mechanism thereby enabling adjustment of rotational resistance.

* * * * *